US007417662B2

(12) United States Patent
Wing et al.

(10) Patent No.: US 7,417,662 B2
(45) Date of Patent: Aug. 26, 2008

(54) SENSOR MODULE DOCKING ARRANGEMENT WITH MULTIPLE DEGREES OF FREEDOM CONSTRAINT

(75) Inventors: Joseph M. Wing, Ontario, NY (US); Brian J. Perry, Honeoye, NY (US)

(73) Assignee: Xerox Corporation, Norwalk, CT (US)

( * ) Notice: Subject to any disclaimer, the term of this patent is extended or adjusted under 35 U.S.C. 154(b) by 246 days.

(21) Appl. No.: 11/531,016

(22) Filed: Sep. 12, 2006

(65) Prior Publication Data

US 2008/0062245 A1 Mar. 13, 2008

(51) Int. Cl.
*B41J 2/435* (2006.01)
*G03G 15/00* (2006.01)

(52) U.S. Cl. ..... 347/263; 399/165

(58) Field of Classification Search ..... 347/116, 347/138, 154, 241, 256, 263; 399/163, 165; 271/226, 306

See application file for complete search history.

(56) References Cited

U.S. PATENT DOCUMENTS 5,326,093 A * 7/1994 Sollitt ..... 271/306
5,553,843 A * 9/1996 Schenk ..... 271/226
5,737,003 A * 4/1998 Moe et al. ..... 347/116
7,212,221 B2 * 5/2007 Walsh et al. ..... 347/138

* cited by examiner

*Primary Examiner*—Hai C Pham
(74) *Attorney, Agent, or Firm*—Oliff & Berridge, PLC

(57) ABSTRACT

A docking system may repeatedly dock a movable sensor module relative to another module with high precision. The docking system may move with minimal constraints and several degrees of freedom. The docking system may be particularly useful for precisely locating a movable sensor module relative to another module, such as a full width array sensor relative to a photoreceptor module within an image forming apparatus. A high degree of freedom may be achieved through use of a series of at least three spherical bearing connections that enable freedom of movement about X, Y and Z axes.

20 Claims, 11 Drawing Sheets

FIG. 3
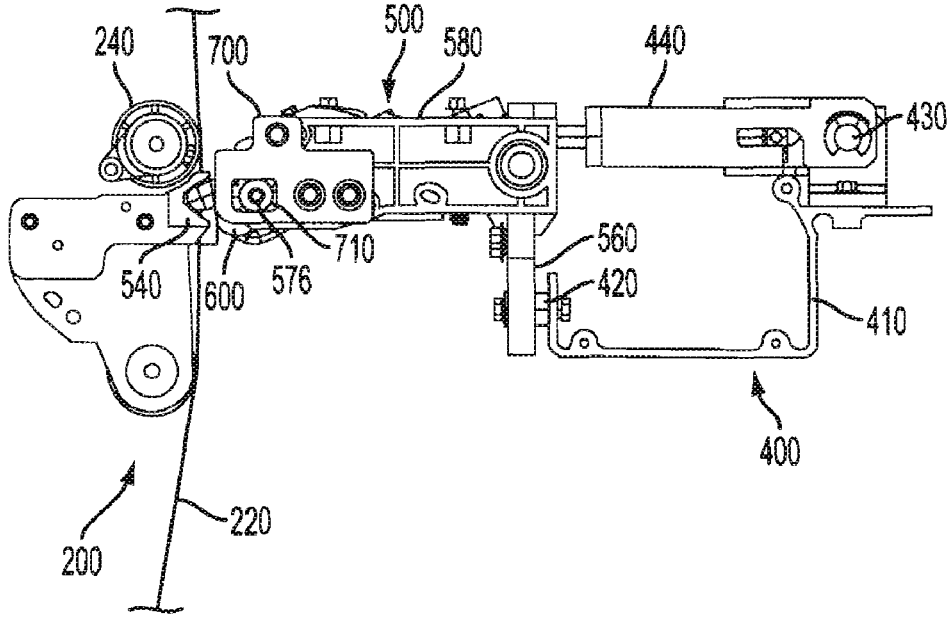
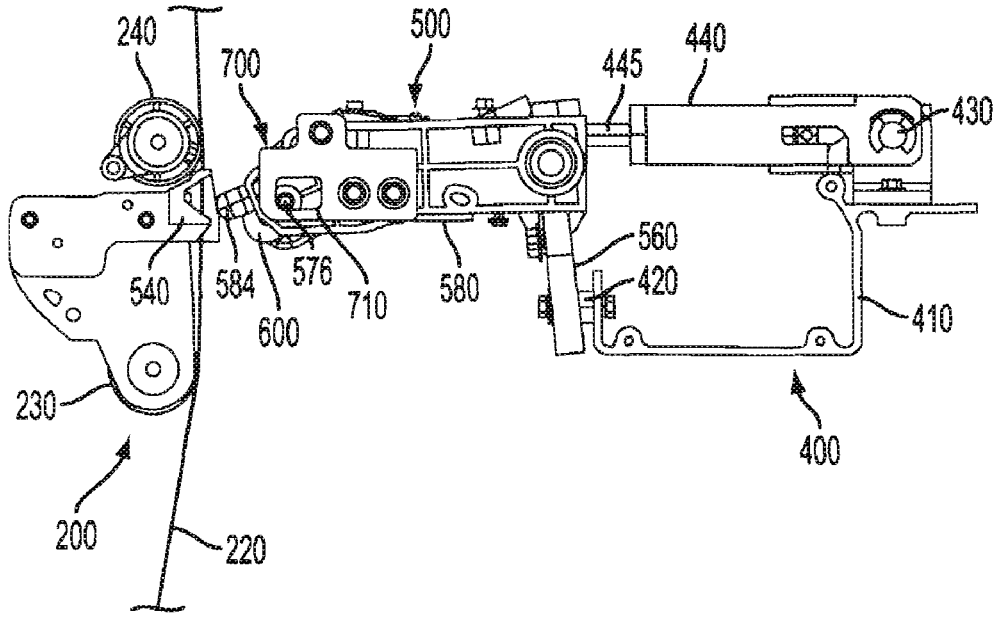
FIG. 4

SENSOR MODULE DOCKING ARRANGEMENT WITH MULTIPLE DEGREES OF FREEDOM CONSTRAINT

BACKGROUND

This disclosure generally relates to a docking system for repeatedly docking a movable sensor module relative to a module with high precision. Such a docking system may move with fewer constraints and more degrees of freedom. Such a docking system may be particularly useful for precisely locating a movable sensor module relative to another module, such as a full width array sensor relative to a photoreceptor module within an image forming apparatus.

SUMMARY

Cross-process non-uniformities, commonly referred to as streaks, are considered to be one of the biggest customer complaints with digital production presses. Current architectures and technology sets contain a number of different streak sources that often cannot be satisfactorily controlled via design or system optimization. To achieve image quality demands of current and future customers, there is a need for systems that automatically correct for streaks and cross-process non-uniformities that may otherwise be produced.

One approach to address the streaks is a service tool for a digital production press. The tool enables correction for stable sources of spatial low-frequency non-uniformities in prints, such as the raster output system (ROS) fast-scan spot size profile. A print non-uniformity is sensed using an offline spectrophotometer connected to a Portable Work Station (PWS). Corrections are made through a ROS intensity profile via a rolloff correction curve. While extremely successful in correcting for some problems, this solution does not address or help with time-varying and/or narrower streaks, which may still be present.

To address the troublesome streaks, many of which are found in the developed image on a photoreceptor (P/R) belt, another approach has been attempted. This second approach relies on a closed-loop system that senses non-uniformities of developed images on the photoreceptor belt using a full width array (FWA) sensor. The system corrects for sensed non-uniformities by applying of spatial Tone Reproduction Curves (TRC) in a Contone Rendering Module (CRM).

In the existing architecture, the FWA sensor is provided in a right X-Tower of the digital production press. This allows necessary patch measurements to be taken while printing (in inter-print zones), allowing corrections to be made without disrupting the printing of customer jobs.

For the FWA sensor to take appropriate measurements, the FWA sensor must be mounted and located accurately in relation to the photoreceptor belt. However, because the belt must be accessible for replacement, adjustment or maintenance, it is desirable for the photoreceptor module to be movable to provide complete access to the belt.

FIG. 1 shows a photoreceptor module 200 and an X-tower module 300 on which is mounted a full width array sensor 600. To provide access to the photoreceptor belt 220 driven by drive roll 210, the photoreceptor module 200 and/or adjacent modules, such as the X-tower 300, must be relatively moved out of the way. In an exemplary system, the X-tower module moves in the X-direction up to 228 mm while the photoreceptor module moves up to 114 mm. Photoreceptor module 200 may then be extracted in the Z-direction to provide access to the photoreceptor belt 220. However, because this movement alters the alignment of the FWA sensor, upon completion of the repair or replacement operation, it may become necessary to reposition the various modules so that the sensor 600 is again precisely located.

In the case of an exemplary fall width array sensor, the sensor spans the entire width of the belt and has a length of about 15". To achieve a high degree of accuracy in measurement, the sensor should maintain placement tolerances of ±0.6 mm with an angular orientation of less than ±1.5°. Because of the need to use movable modules, the placement tolerances must be repeatable upon every return of the modules to an operating position after a repair or maintenance procedure. Also, because of the large length of the sensor, this also requires precise control of the angle of the sensor about several axes to ensure that the accuracy is maintained along the entire length of the sensor. Thus, providing a precise, repositioning of the sensor has been difficult to achieve.

Aspects of the disclosure describe a system that removably mounts and locates a sensor, such as a full width array (FWA) sensor, within an image forming apparatus with a desirable degree of freedom (compliance) to locate the sensor to a reference surface or module, such as the photoreceptor belt, with a desired accuracy.

In accordance with aspects of the disclosure, the repositionable mounting structure may not be overly constrained, allowing an image module frame module containing the sensor to move with several degrees of freedom and contact various locating features on, the photoreceptor module without any undesirable part deflections. This freedom and minimal deflection may result in an efficient mechanical mechanism, a minimal amount of force to keep the image module in its operating position, and highly accurate positioning.

In accordance with an exemplary embodiment, various modules within the image forming apparatus include the photoreceptor module, the FWA sensor, a docking module, a loading module, and a right X-tower.

In accordance with aspects of the disclosure, desired degrees of freedom may be achieved through the use of a series of spherical bearings that allow limited movements about several planes and axes.

In accordance with aspects of the disclosure, a docking system for repeatedly and precisely docking a full width array sensor relative to an image forming apparatus module may be provided. The docking system includes: an image forming apparatus module; inboard and outboard docking blocks fixedly mountable to the image forming apparatus near inboard and outboard sides thereof; a second module adjacent to the image forming apparatus module that is movable relative to the image forming apparatus module between a first docked position and a second undocked position; a loading module fixedly mounted within the adjacent second module; a docking module provided between the image forming apparatus module and the loading module, the docking module including a sensor fixedly mounted thereon and inboard and outboard protrusions that mate with the inboard and outboard docking blocks when the second module is in the docked position and release from the docking blocks when the second module is in the undocked position; and at least one biased plunger mounted to the loading module that applies an urging force to the docking module to retain the inboard and outboard protrusions against the docking blocks at least when the second module is in the docked position. The docking module is preferably loosely constrained with multiple degrees of freedom by three spherical bearings that are configured to allow the docking module to at least rotate about X, Y and Z axes with limited mobility when the second module is moved between the docked position and the undocked position, In accordance with further aspects of the disclosure, an image forming apparatus may include a docking system for docking, preferably repeatedly a full width array sensor relative to the image forming apparatus. The image forming apparatus may include: a photoreceptor module including a photoreceptor belt; inboard and outboard docking blocks fixedly mounted to the photoreceptor module near inboard and outboard sides of the photoreceptor belt; a second module adjacent to the photoreceptor module that is movable relative to the photoreceptor module between a docked position and an undocked position; a loading module fixedly mounted within the adjacent second module; a docking module provided between the photoreceptor belt and the loading module, the docking module including a front plate having a full width array sensor fixedly mounted thereon, inboard and outboard side frame plates, and a back side load plate, the front plate also including inboard and outboard protrusions that mate with the inboard and outboard docking blocks when the second module is in the docked position and release from the docking blocks when the second module is in the undocked position; and at least one biased plunger mounted to the loading module that applies an urging force to the docking module to retain the inboard and outboard protrusions against the docking blocks at least when the second module is in the docked position. The image module may be loosely constrained with multiple degrees of freedom by a series of at least three spherical bearings. A first spherical bearing connection is between the docking module back side load plate and the loading module, a second spherical connection is between the inboard side surface and the back side surface of the docking mechanism, and a third spherical connection between the outboard side plate and the load plate so that the image module can at least rotate about the X, Y and Z axes with limited mobility.

BRIEF DESCRIPTION OF THE DRAWINGS

Exemplary embodiments will be described with reference to the accompanying drawings, in which like numerals represent like parts, and wherein:

FIG. 3 shows a side view of a docking module on which the sensor module is precisely located with limited constraints between the photoreceptor module and the X-tower module in a docked position;

FIG. 4 shows a side view of FIG. 3 in an undocked position in which the photoreceptor module and the X-tower module are relatively moved away from each other;

DETAILED DESCRIPTION OF EMBODIMENTS

Figure 1:
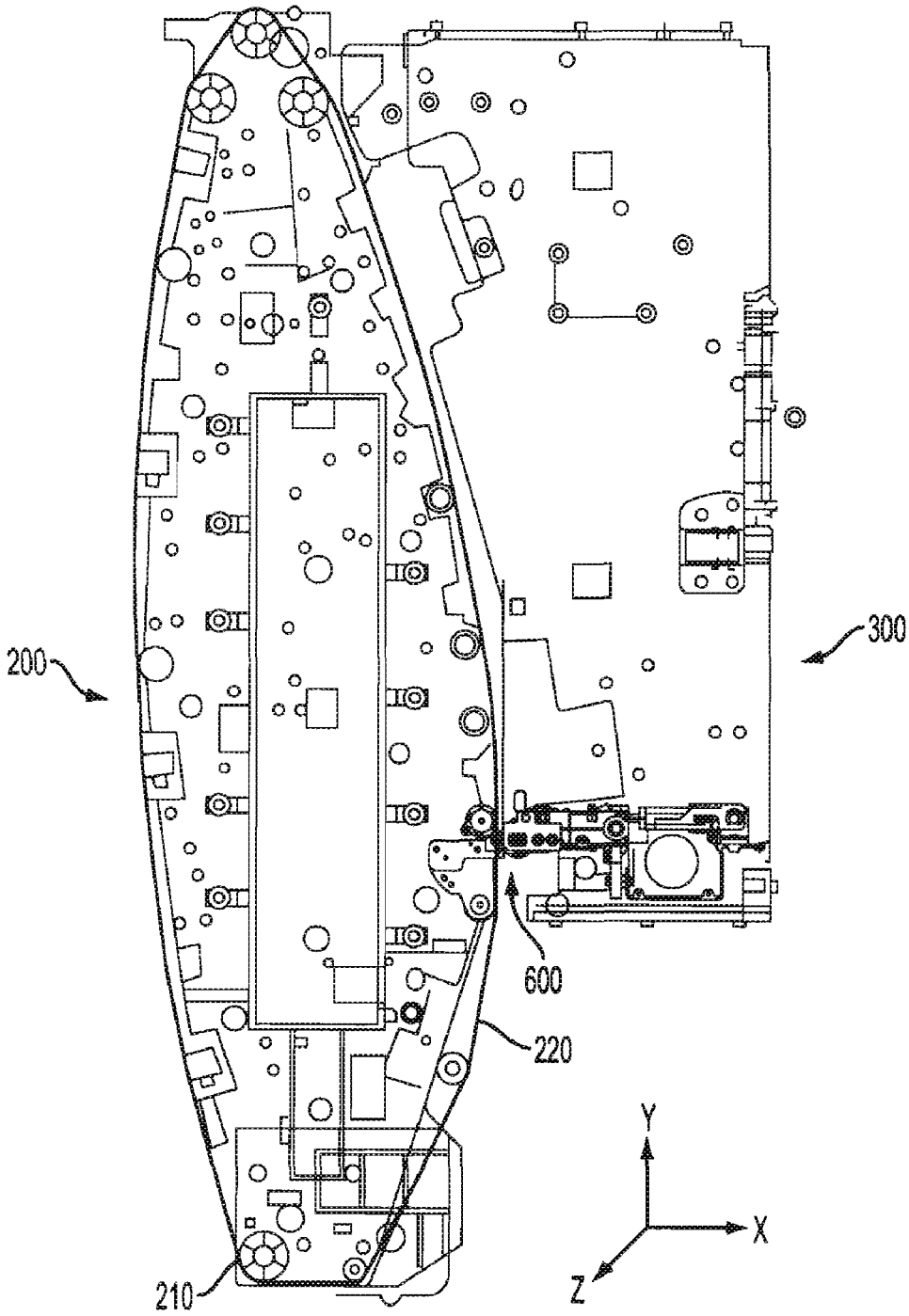
FIG. 1 shows a side partial view of an exemplary image forming device with two relatively movable modules in the form of a photoreceptor module and an X-tower module, one of which includes a high precision sensor module.

An exemplary embodiment of the disclosure will be described with reference to FIGS. 1-14, which show components of an exemplary docking system for use in an image forming apparatus. In this disclosure, left/right movement is referred to as "X" direction movement, up/down movement is referred to as "Y' direction movement, and in/out movement is referred to as "Z" direction movement.

Various components shown in FIG. 3-13 include a docking module 500 that supports a full width array (FWA) sensor 600 (shown in FIG. 9) and a loading module 400 mounted within X-tower 300 that supports portions of the docking module 500.

Due to the mechanical architecture of such an image forming apparatus, it is desirable to locate the docking module 500 within the right X-tower 300 rather than entirely on the photoreceptor module 200. This is because the external surface of the photoreceptor should be free of external obstacles to enable removal of the belt 220 from the photoreceptor module 200.

Figure 2:
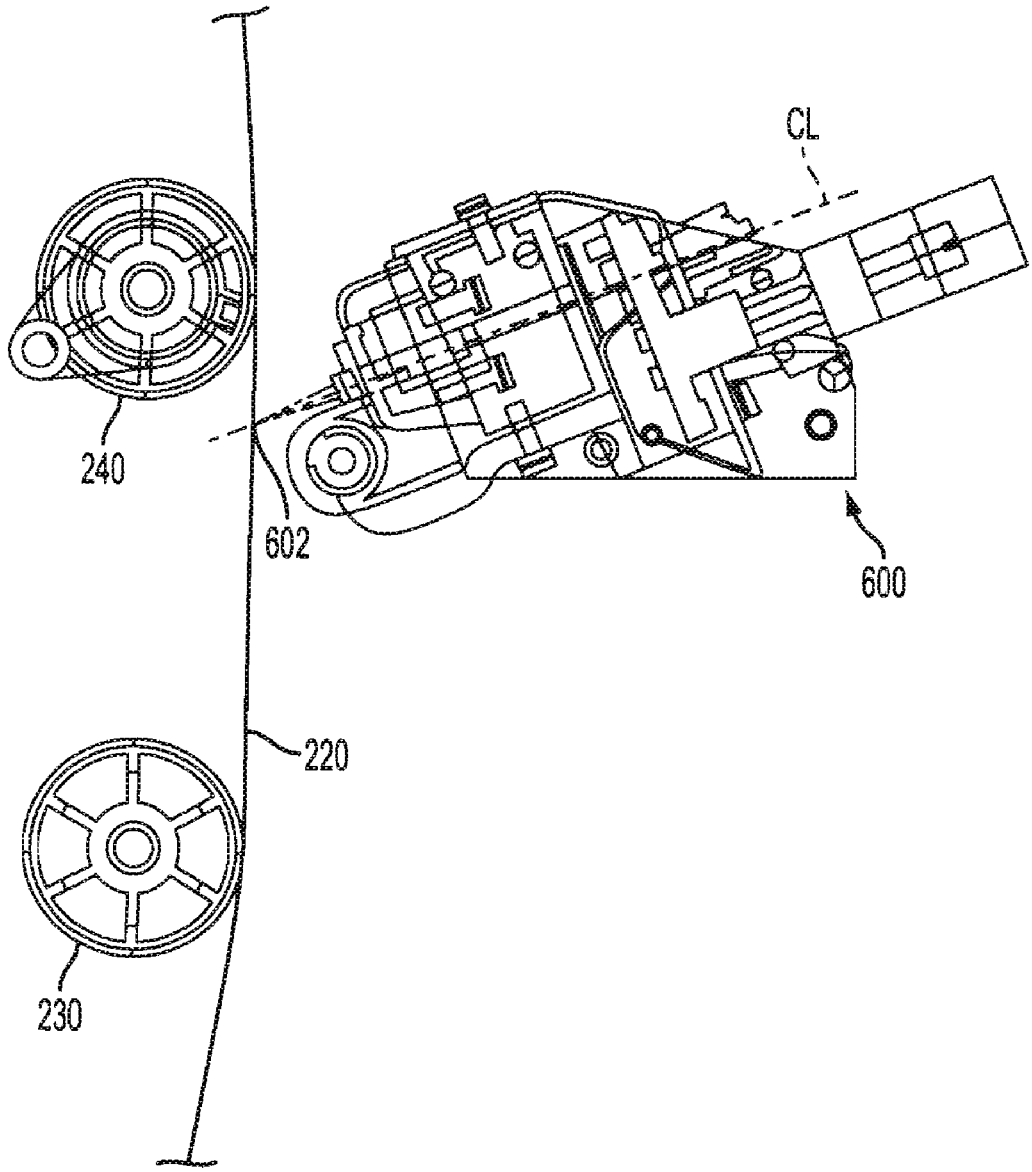
FIG. 2 shows a side view of the sensor module precisely located relative to a photoreceptor belt surface of the photoreceptor module.

For the FWA sensor 600 to perform correctly, sensor 600 should be located to the photoreceptor belt 220 on photoreceptor module 200 in a specific position and attitude. For example, the focal point 602 of the sensor lens should be positioned at the photoreceptor belt surface to within a tolerance of 0.0±0.6 mm. The lens centerline should be positioned at an angle of 22.5±1.5° from perpendicular to the photoreceptor belt plane (FIG. 2). The FWA lens of FWA sensor 600 also should be aligned parallel to the photoreceptor module drive roll 210 within 0.9 mm over the length of the maximum image to be read. This may include an image length of over 14 inches.

However, certain maintenance or repair procedures require access to various modules. For example, a Customer Service Engineer (CSE) may require changing of a photoreceptor belt or perform maintenance to the photoreceptor module or right X-tower module. To achieve this, it may be desirable for the various modules to move relative to the imaging device or various other modules for access. In the illustrative example, the photoreceptor module 200 moves 114 mm to the right and 3 mm down and the right X-tower 300 moves 228 mm to the right and 2 mm down from a "machine operating position" to a "P/R Module undocked position." Thus, upon completion of the necessary repair or maintenance, there is a need to efficiently return the sensor module to the desired precise position and attitude for optimal sensing.

FIG. 3 shows the docking module 500 and a loading module 400 in a docked position in which a FWA sensor 600 within the module is precisely located relative to the photoreceptor belt 220 of photoreceptor module 200. Thus, any mounting structure used for the FWA sensor 600 should be capable of allowing movement, including non-linear movement, of the modules while being capable of returning the FWA sensor 600 back to desired positioning. Preferably, this alignment is reliable and repeatable for each movement of the modules between docked and undocked positions. Although not shown in this figure, docking module 500 and loading module 400 are mounted within X-tower 300.

FIG. 4 shows the docking module 500 and loading module 400 in an undocked position upon movement of the X-tower relative to the photoreceptor module for a maintenance or repair operation. As can be seen from the drawings, docking module 500 may be loosely constrained relative to loading module 400 and photoreceptor belt 220 to allow limited movement about several axes relative to loading module 400 and photoreceptor module 200. This ensures that the components can freely move apart yet precisely align without binding upon return to the docked position. This loose constraint also assists in movement of the various modules to the undocked separation stations while also allowing flexibility to return to the precise desired position and attitude upon return to the docked position. Additional details of the docking and alignment will be described after the following discussion of individual components.

Figure 5:
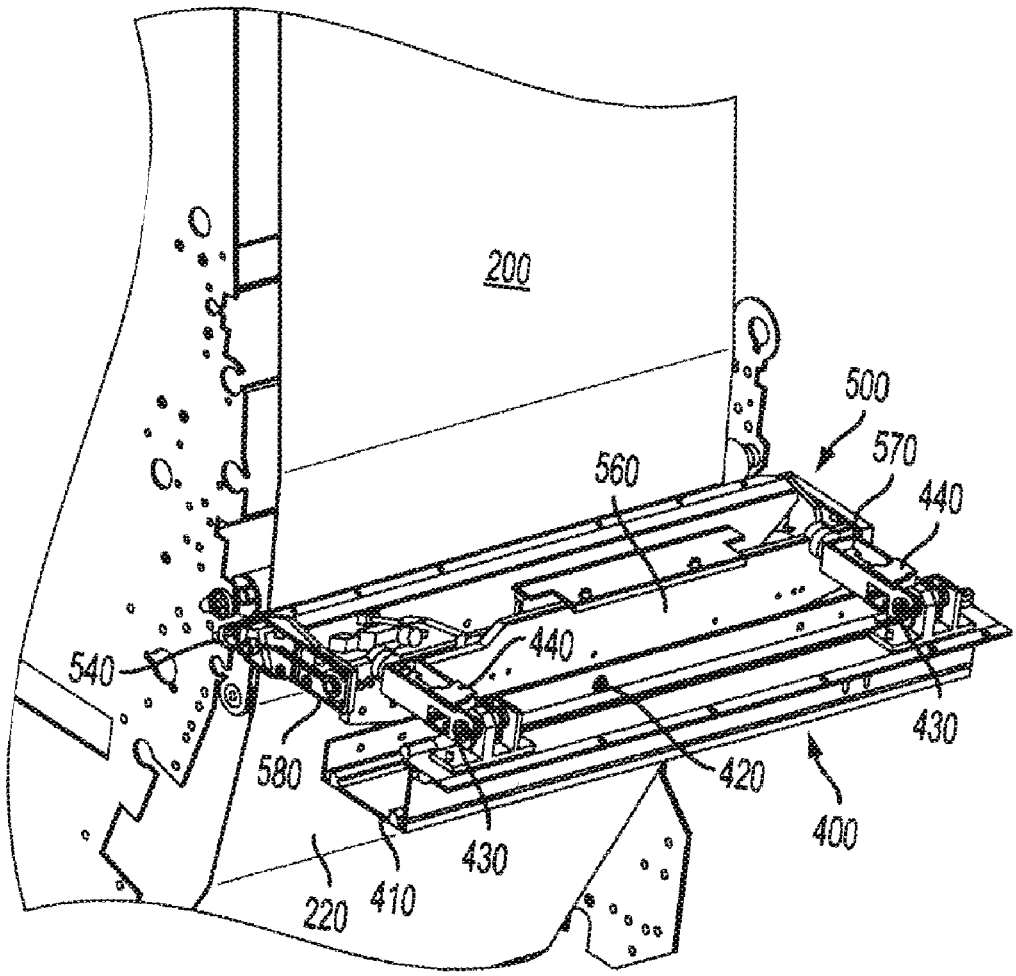
FIG. 5 shows a perspective view of FIG. 3.
Figure 13:
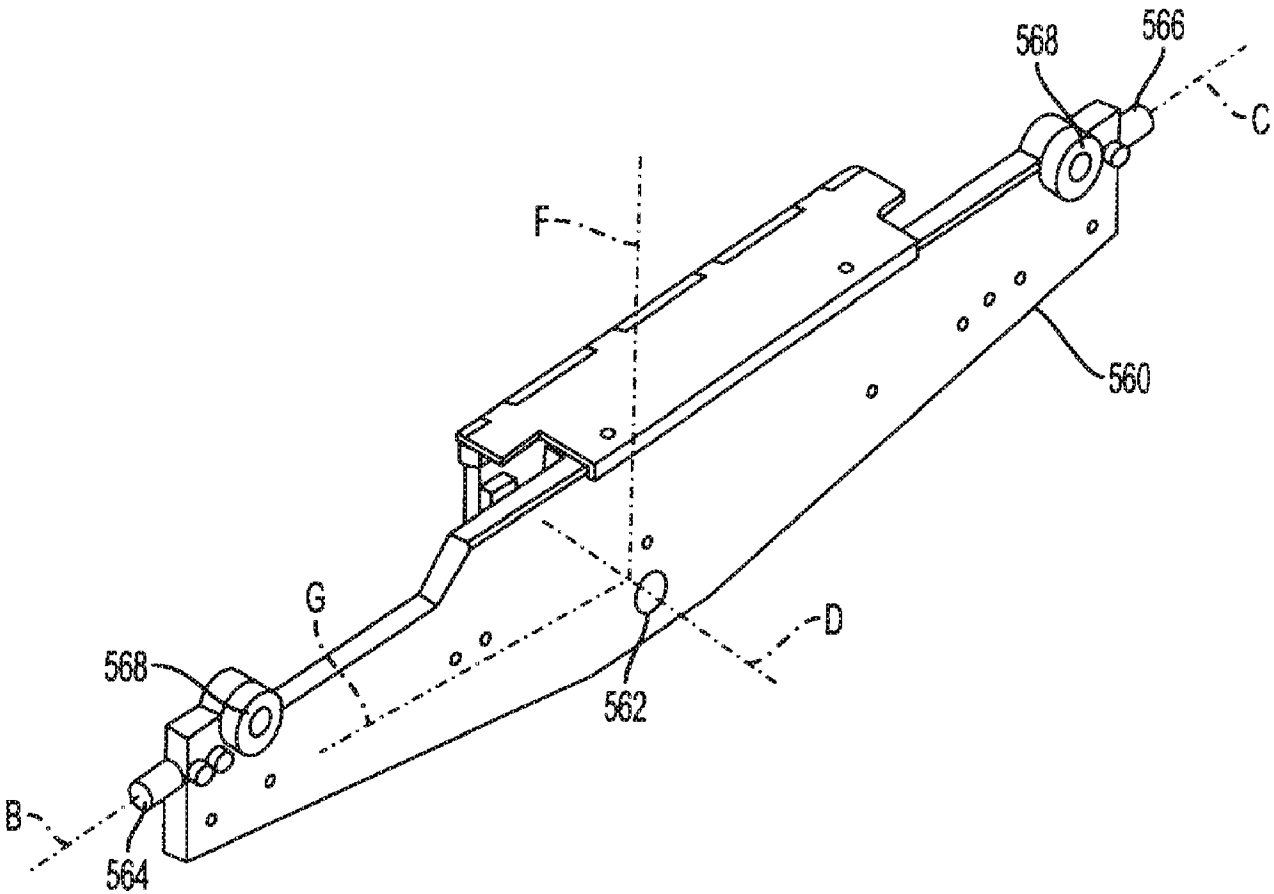
FIG. 13 slows another partial perspective view of the docking module of FIG. 9 showing the rear plate.

As shown in FIGS. 3-5, loading module 400 includes a U-shaped frame 410. Frame 410 is fixedly mounted within X-tower 300 by suitable means (unshown). A pivot shaft 420 (better shown in FIGS. 10-11) is centrally located on a front surface of frame 410 and receives a first spherical bearing 562 (FIG. 13) provided within a load plate 560 (FIG. 13).

A pair of plunger pivot blocks 440 are provided on a top surface of frame 410 and connected to the frame through second and third spherical bearings 430. Pivot blocks 440 each include a spring-loaded plunger 445 on a front surface. Plungers 445 provide an urging force against docking module 500 to urge module 500 towards photoreceptor module 200 to retain the docking module 500 in the docked position. These features are better shown in FIGS. 10-11.

Figure 6:
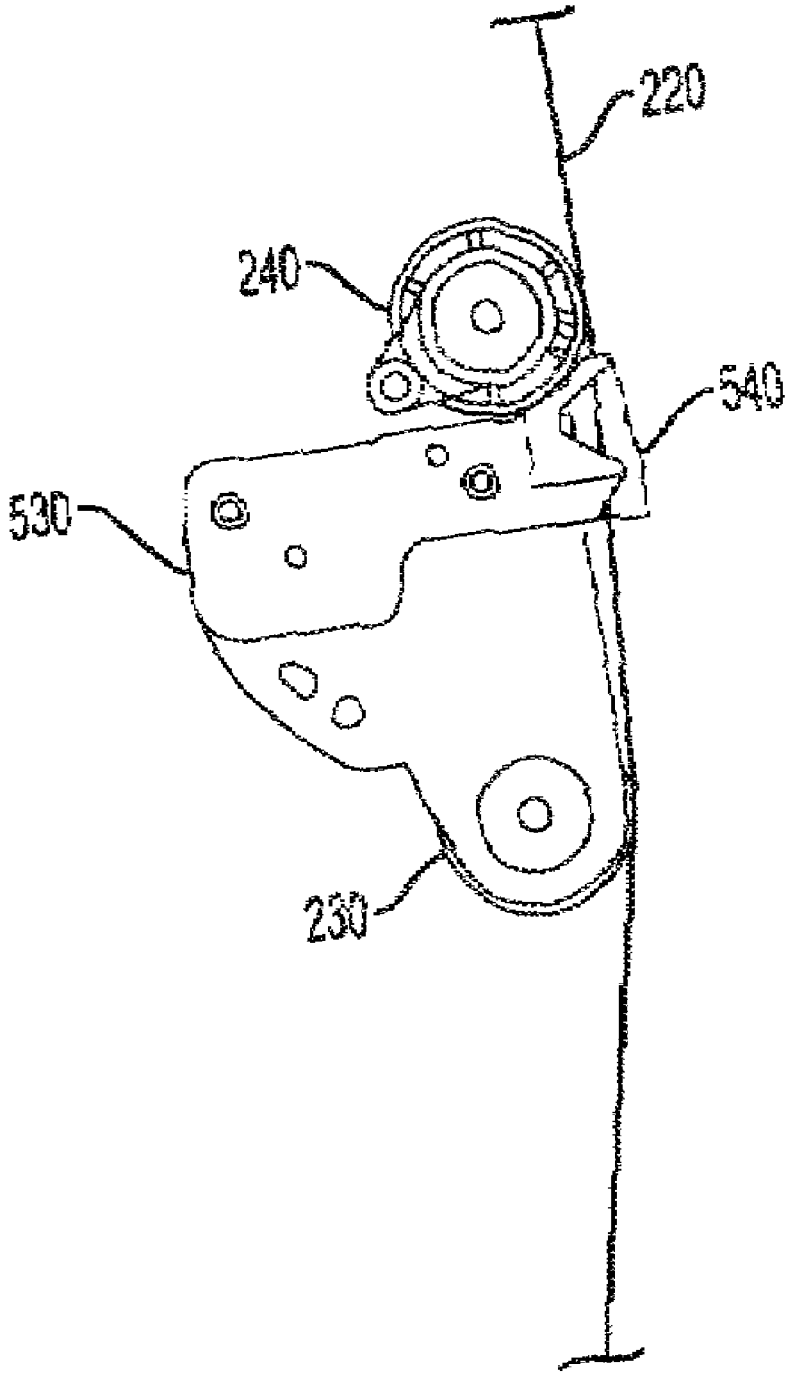
FIG. 6 shows a partial side view of the photoreceptor module of FIG. 1 showing image module rolls, a docking frame, and docking blocks.
Figure 7:
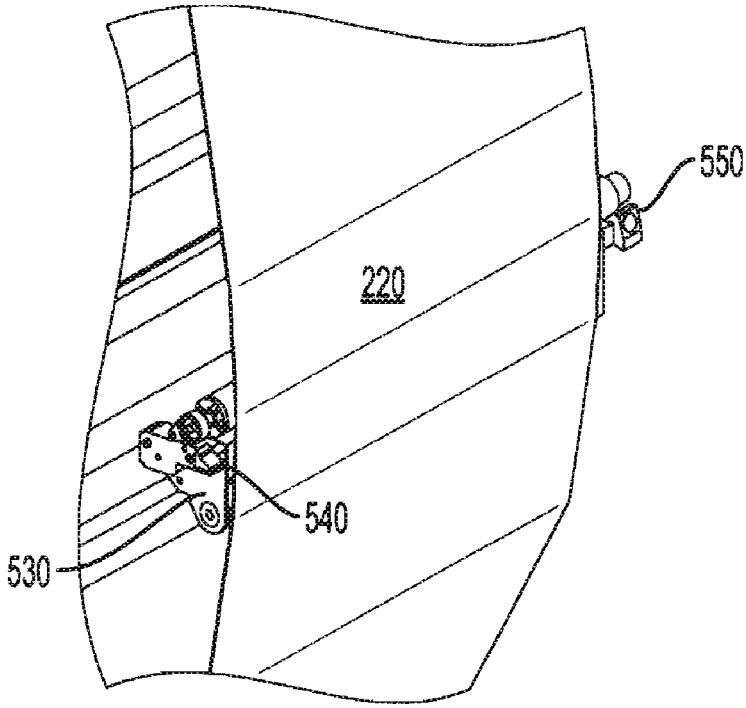
FIG. 7 shows a perspective view of FIG. 6 showing inboard and outboard docking blocks.
Figure 8:
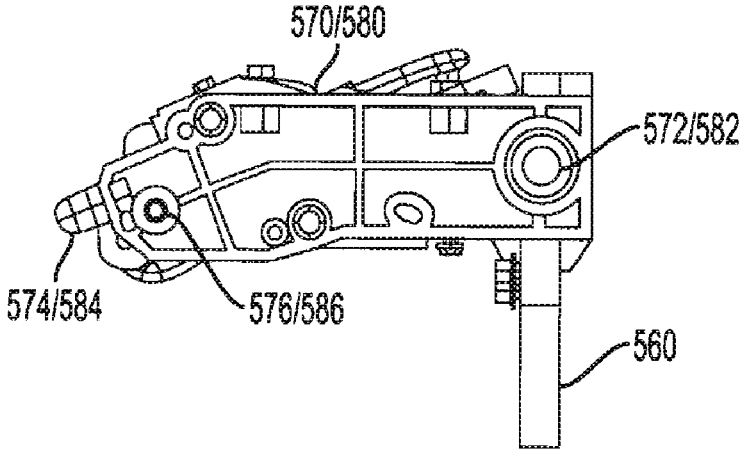
FIG. 8 shows a side view of an exemplary docking module on which the sensor is mounted.

Docking module 500 includes several components loosely mounted to loading module 400 and several docking components fixedly mounted to the photoreceptor module 200. As best shown in FIGS. 6-7, photoreceptor module 200 includes an image module isolation roll 230 and an image module backup roll 240. Docking frames 530 that include docking blocks 540, 550 are located on inboard and outboard sides of the photoreceptor belt 220 in the vicinity of the rolls 230, 240. One of the docking blocks (540) is provided on the outboard side while the other (550) is provided on the inboard side. Preferably, at least one of the docking blocks is shaped to accurately locate the docking frame 500 in at least one different direction than the other block. In the exemplary configuration shown, docking block 540 is a V-block in a V-shape that locates the sensor in X and Y directions while docking block 550 is in the form of a countersunk hole that locates the sensor in X, Y and Z directions.

Figure 9:
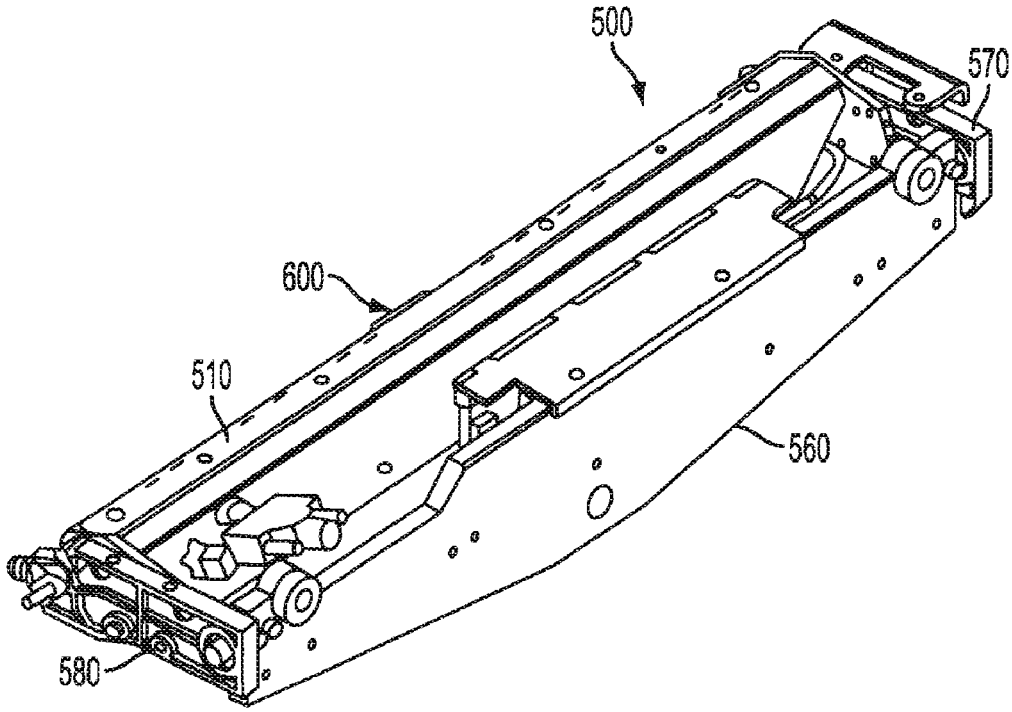
FIG. 9 shows a perspective view of FIG. 8.
Figure 10:
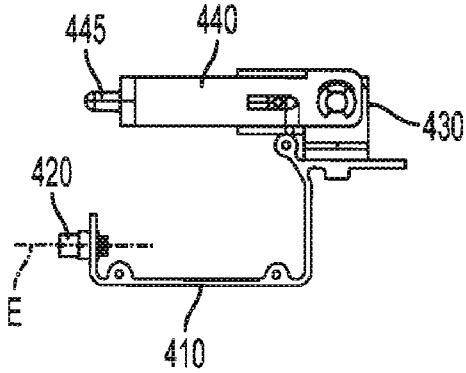
FIG. 10 shows a side view of an exemplary loading module mounted within the X-tower (X-tower omitted for clarity)
Figure 11:
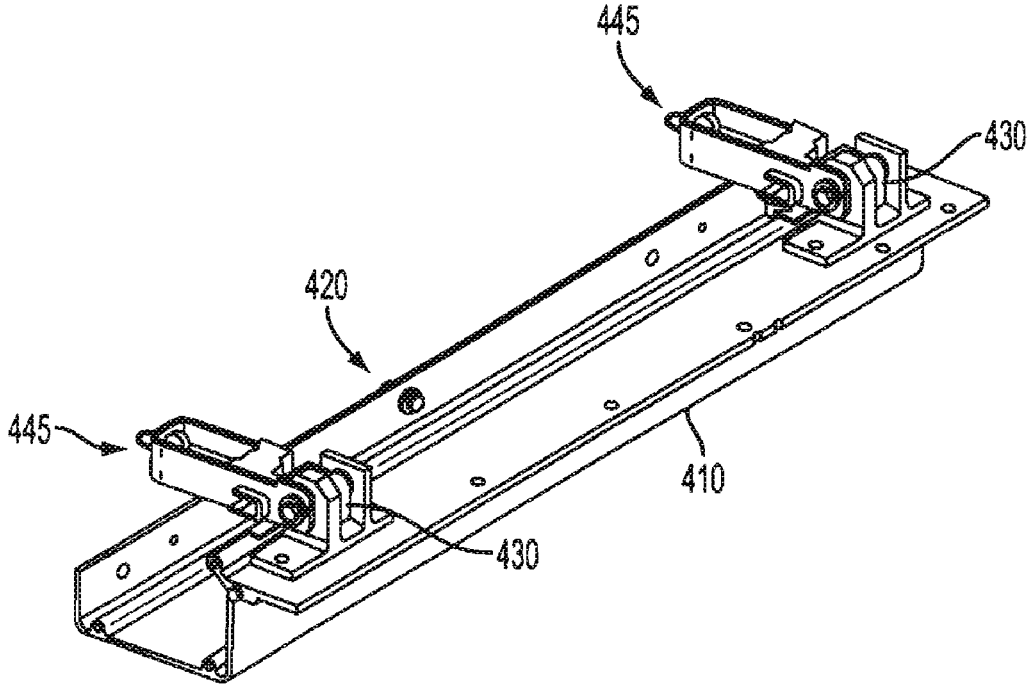
FIG. 11 shows a perspective view of FIG. 10.
Figure 12:
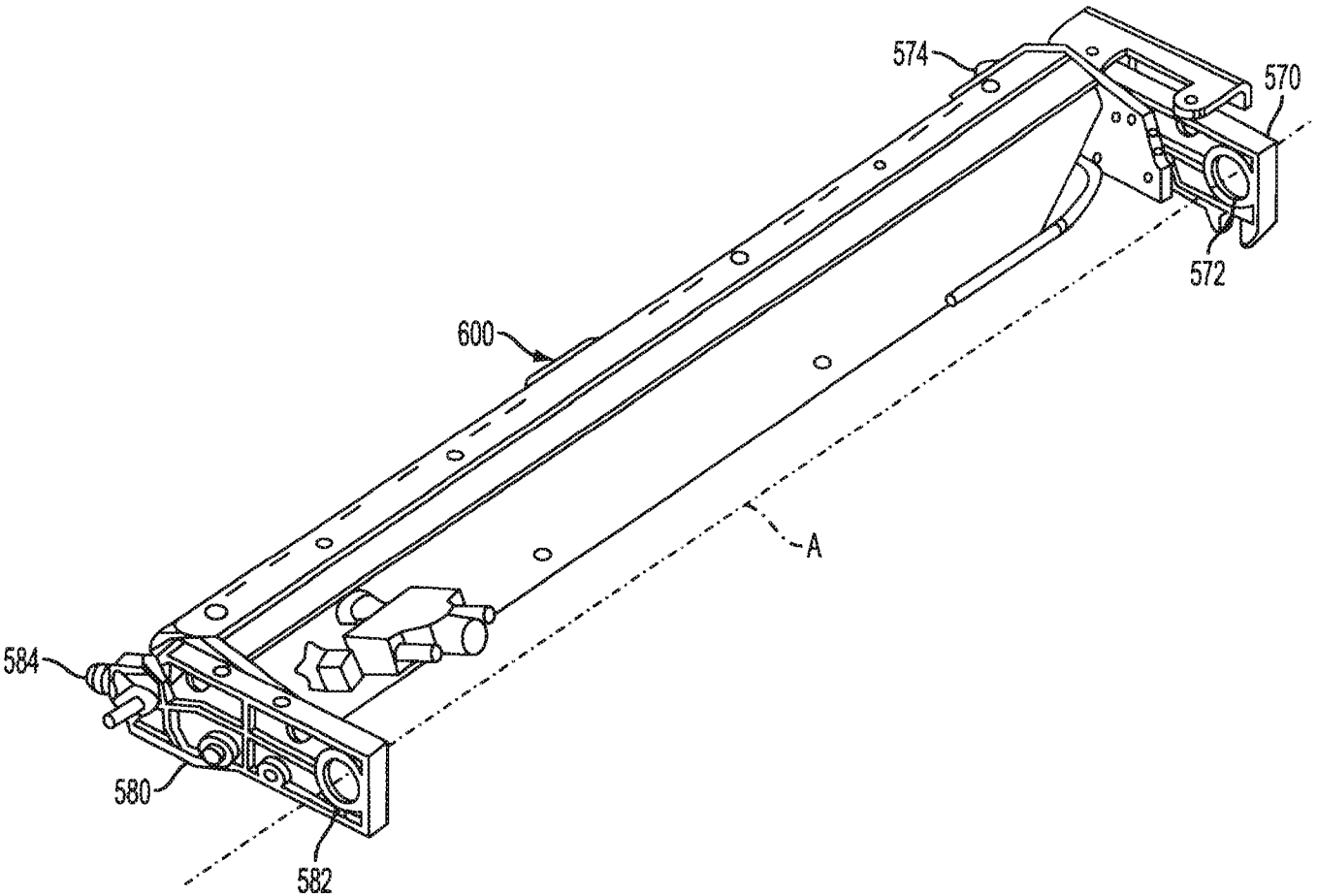
FIG. 12 shows a partial perspective view of the docking module of FIG. 9 with a rear plate omitted for clarity.

Additional components of docking module 500 are shown in FIG. 9 and 12 and include a front housing 510 on which FWA sensor 600 is fixedly mounted, back side load plate 560, inboard frame plate 570, and outboard frame plate 580. The front housing is a casting so that when connected to frame plates 570, 580, the module becomes relatively rigid. A rear end of inboard frame plate 570 includes a fourth spherical bearing 572 while a rear end of outboard frame plate 580 includes a fifth spherical bearing 582. These spherical bearings receive load plate 560 and define an axis A (FIG. 12). Due to the bearings 572, 582 being of the spherical type, the inner race of each bearing can rotate so that the axis of each bearing can align to the other along axis A.

A front end of inboard frame plate 570 includes a spherical protrusion 574 while a front end of outboard frame plate 580 includes a similar spherical protrusion 584. Protrusions 574, 584 are provided to mate with and precisely align with docking blocks 540 and 550 to control position and orientation of sensor 600.

As best shown in FIG. 13, the load plate 560 has several features that enable movement of the module with several degrees of freedom. In particular, docking module load plate spherical bearing 562 is located at the bottom center of the plate and mounts on pivot shaft 420. This allows rotation about axis D. Pivot shafts 564 and 566 are provided for mating with spherical bearings 582 and 572, respectively, of the inboard and outboard frame plates 570, 580. This structure allows rotation of plate 560 about axis B/C. Moreover, because of spherical bearing 562, limited B/C axis rotation may also be possible. Spring loaded plungers 445 are received by spring loaded plunger receptacles 568 near outer top edges of the plate to urge the module 500 against docking blocks 540, 550. As shown in FIG. 13, the vertical axis originating from the pivot point of the spherical bearing 562 is axis F and the horizontal axis originating from the pivot point of the spherical bearing 562 is axis G.

For the FWA sensor 600 to be located properly to the photoreceptor belt 220, the image module 500 should be aligned to the photoreceptor module 200 while accommodating specific linear and/or non-linear movements of the modules 200, 300 necessary for separation. For the docking module 500 to make proper contact with its locating features on the photoreceptor module 200, docking module 500 needs at least the following degrees of freedom: rotation around the X, Y and Z axes.

The image module inboard and outboard docking blocks 550, 540 are fixedly located in the photoreceptor module 200 so that when the spherical protrusions 574, 584 on side plates 570, 580 locate into them the lens of FWA sensor 600 is then correctly located relative to the photoreceptor belt 220. Also, the lens of FWA sensor 600 is correctly aligned relative to the photoreceptor drive roll 210.

The "Y" relationship between the inboard and outboard docking blocks 550, 540 located in the photoreceptor module and the load plate pivot shaft 420, located in the right X-tower 300, sets the suitable angle of the lens of the FWA sensor 600.

When all of the subsystems are in the machine operating position they are located correctly. When the machine is placed into the photoreceptor module undocked position (FIG. 4), the photoreceptor module 200, tight X-tower 300, and the docking module 500 lose their accurate location. The photoreceptor module 200 moves away from what locates it into a print engine. The right X-tower 300 moves away from the photoreceptor module that locates it. The docking module 500 moves away from the photoreceptor module, which locates part of it. The only subsystem that will be addressed as to how it gets its operating position back again is the docking module 500.

When the docking module 500 moves to its undocked position it rotates around the "Z" Axis (axes A and G). Once docking module 500 moves away from the photoreceptor module 200 docking module 500 is free to move (with limited movement) through all of its degrees of freedom, limited by the travel of the spherical bearings. Movement may also be limited by two image module stop blocks 700 that are mounted on the right X-tower 300. These blocks may limit movement of the sensor side of docking module 500 (front side containing sensor 600). The movement limit is designed to position the inboard and outboard spherical protrusions 574 and 584 within the acceptable receiving range of docking blocks 540, 550 when the right X-tower 300 moves to the left (into its operating position) and makes contact with the photoreceptor module 200. That is, the motion may be controlled to ensure that the spherical protrusions 574, 584 will mate with and align relative to docking blocks 540, 550. In particular, stop blocks 700 may include a window 710 that receives a dowel pin 576 protruding outward from side frame plates 570, 580 (FIGS. 3-4). Window 710 may define the boundaries of movement of the dowel pin, which controls movement of the front side of the docking module 500. Alternatively, the stop blocks 700 may include a dowel pin and the side frame plates could include the window. In an exemplary embodiment, movement is constrained to only a few millimeters, preferably ±5 mm of left to right movement (X axis) and ±3 mm up to down movement (Y axis).

Figure 14:
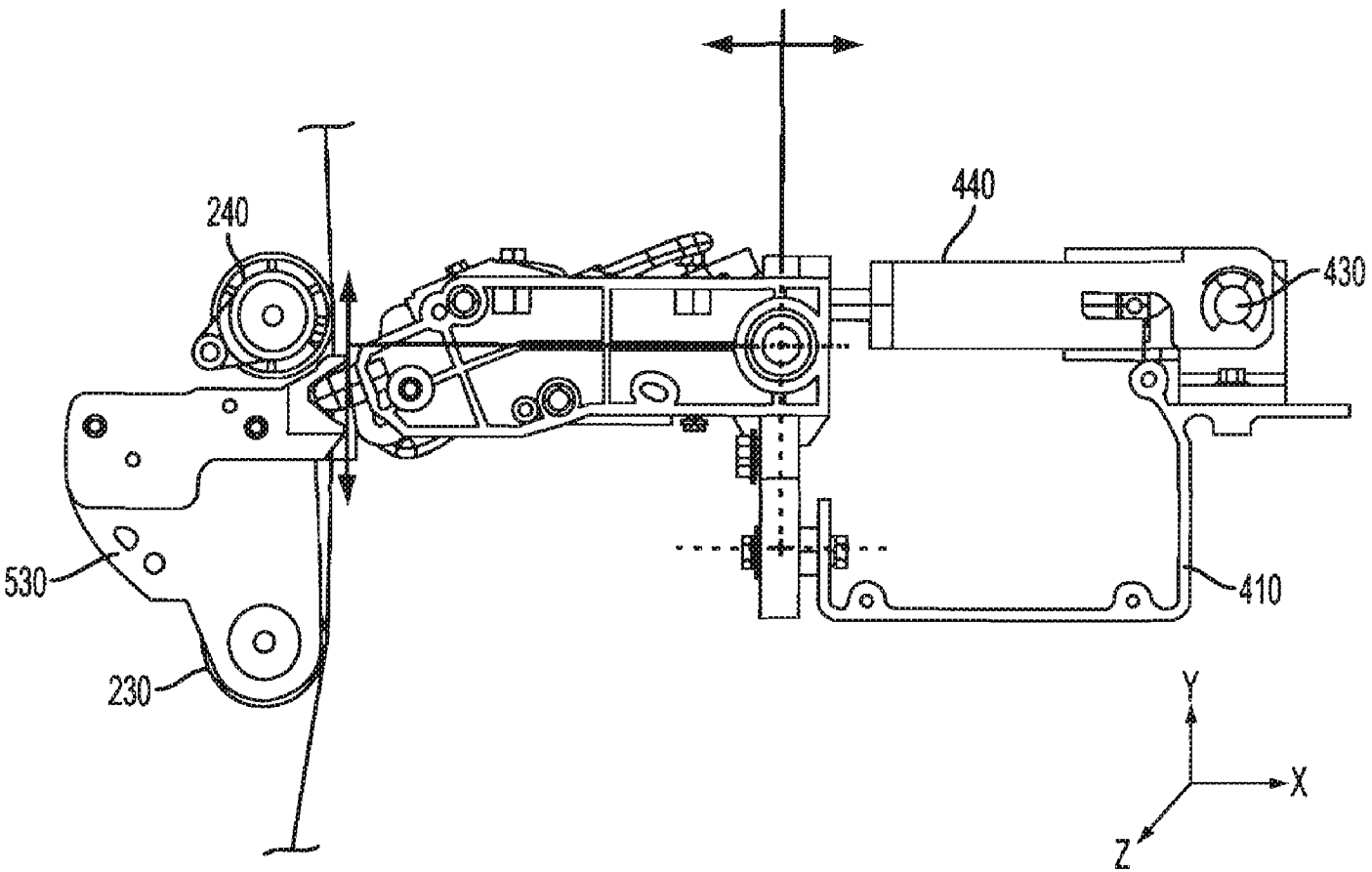
FIG. 14 shows a side view of the docking module of FIG. 4 including illustrations for the degrees of freedom.

As the docking module 500 moves to its operating position (docked position) it is free to move through all of its degrees of freedom as shown in FIG. 14. The spherical protrusions 574, 584 move into the respective docking blocks 540, 550 to precisely position the image module 500 in the X, Y and Z directions. In an exemplary embodiment, inboard docking block 550 has a conical shape and the corresponding spherical protrusion 574 has a spherical shape that interfaces therewith. The outboard docking block 540 in an exemplary embodiment has a V-shape and the corresponding spherical protrusion 584 has a complementary shape that interfaces therewith. Throughout all of the movements the spring-loaded plungers 445 apply a sufficient force to the docking module 500 to ensure proper positioning in all of its positions. Moreover, because each spring-loaded plunger mechanism 445 has a spherical bearing associated with it (bearings 430), the impedance that the plungers may have on the docking module 500 is minimized.

A tolerance analysis of the parts involved in the disclosure indicates that if all of the piece parts are within their drawing specifications, the FWA sensor 600 will be located within its positional requirements.

Docking module 500 has all of the necessary degrees of freedom to locate the FWA sensor 600 to the photoreceptor module 200 and right X-tower 300 through use of three (3) and preferably five (5) spherical bearings. This results in no undesirable deflections and no undesirable impedances to module 500 motions. Moreover, only a minimal amount of force is needed to ensure proper positioning of FWA sensor 600.

Although described with reference to a full width array sensor, the disclosure is applicable to other types of sensors that have a criticality to their placement. It is particularly applicable to sensors having any substantial width or height that requires accuracy in positioning along the entire dimension.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A docking system for docking a sensor relative to an image forming apparatus module, comprising:

inboard and outboard docking blocks fixedly mountable to the image forming apparatus module near inboard and outboard sides thereof;

a second module positionable adjacent to the image forming apparatus module and movable relative to the image forming apparatus module between a docked position and an undocked position;

a loading module fixedly mounted within the adjacent second module;

a docking module provided between the image forming apparatus module and the loading module, the docking module including inboard and outboard protrusions that mate with the inboard and outboard docking blocks when the second module is in the docked position and release from the docking blocks when the second module is in the undocked position; and at least one biased plunger mounted to the loading module that applies an urging force to the docking module to retain the inboard and outboard protrusions against the docking blocks at least when the second module is in the docked position, wherein the docking module is loosely constrained with multiple degrees of freedom by three spherical bearings configured to allow the docking module to at least rotate about the X, Y and Z axes with limited mobility when the second module is moved between the docked position and the undocked position.

2. The docking system according to claim 1, wherein a biased plunger is mounted to the loading module on each of inboard and outboard sides thereof.

3. The docking system according to claim 2, wherein each biased plunger is connected to the loading module through a spherical bearing.

4. The docking system according to claim 1, wherein the loading module includes a pivot shaft extending toward the image forming apparatus module that receives a first spherical bearing provided on a load plate of the docking module to form a first spherical bearing connection.

5. The docking system according to claim 1, wherein at least one of the inboard and outboard docking blocks includes a different configuration from the other to align the sensor along a different axis from the other docking block.

6. The docking system according to claim 5, wherein one of the docking blocks includes a V-groove shape that receives one of the inboard and outboard protrusions and guides the protrusion to achieve a desired X and Y axis alignment upon movement of the second module to the docked position and the other of the docking blocks includes a recessed hole shape that mates with the other protrusion to control alignment in the X, Y and Z axes when the docking module is in the docked position.

7. The docking system according to claim 1, wherein the second module further includes at least one stop block that limits movement of the docking module.

8. The docking system according to claim 7, wherein the one stop block is provided adjacent to the side surface of the docking module and includes one of a window and a dowel pin, the adjacent side surface including a complementary one of a window and a dowel pin configured to cooperate to limit the movement of the docking module.

9. The docking system according to claim 1, wherein a first spherical bearing connects a back surface of the docking module with the loading module, a second spherical connection connects an inboard side of the docking module with the back surface, and a third spherical bearing connects an outboard side of the docking module with the back surface.

10. The docking system according to claim 1, wherein the first spherical connection is provided near a center of the Z axis so that the inboard and outboard docking blocks and the first spherical bearing connection form a Y-shaped support structure.

11. An image forming apparatus having a docking system for docking a sensor relative to the image forming apparatus, comprising:

a photoreceptor module having a photoreceptor belt;

inboard and outboard docking blocks fixedly mounted to the photoreceptor module near inboard and outboard sides of the photoreceptor belt;

a second module adjacent to the photoreceptor module that is movable relative to the photoreceptor module between a docked position and an undocked position;

a loading module fixedly mounted within the adjacent second module;

a docking module provided between the photoreceptor belt and the frame loading assembly, inboard and outboard protrusions that mate with the inboard and outboard docking blocks when the second module is in the docked position and release from the docking blocks when the second module is in the undocked position; and at least one biased plunger mounted to the loading module that applies an urging force to the docking module to retain the inboard and outboard protrusions against the docking blocks at least when the second module is in the docked position, wherein the docking module is loosely constrained with multiple degrees of freedom by provision of three spherical bearings configured to allow the docking module to at least rotate about the X, Y and Z axes with limited mobility.

12. The docking system according to claim 11, wherein a biased plunger is mounted to the loading module on inboard and outboard sides thereof.

13. The docking system according to claim 12, wherein each biased plunger is connected to the loading module through a spherical bearing.

14. The docking system according to claim 11, wherein the frame loading assembly includes a pivot shaft extending toward the image forming apparatus module that receives a first spherical bearing provided on the load plate to form the first spherical bearing connection.

15. The docking system according to claim 11, wherein the inboard and outboard docking blocks each have a different configuration to achieve alignment in different axes.

16. The docking system according to claim 11, wherein one of the docking blocks includes a V-groove shape that receives one of the inboard and outboard protrusions and guides the protrusion to achieve a desired X and Y axis alignment upon movement of the second module to the docked position and the other of the docking blocks includes a recessed hole shape that mates with the other protrusion to control alignment in the X, Y, and Z axes when the docking module is in the docked position.

17. The docking system according to claim 11, wherein the second module further includes at least one stop block that limits movement of the docking module.

18. The docking system according to claim 11, wherein the at least one stop block is provided adjacent at least one side surface of the docking module and includes one of a window and a dowel pin, the adjacent side surface including a complementary one of a window and a dowel pin configured to cooperate to limit the movement of the docking module.

19. The docking system according to claim 11, wherein a first spherical bearing connects a back surface of the docking module with the loading module, a second spherical connection connects an inboard side of the docking module with the back surface, and a third spherical bearing connects an outboard side of the docking module with the back surface.

20. The docking system according to claim 19, wherein the first spherical connection is provided near a center of the Z axis so that the inboard and outboard docking blocks and the first spherical bearing connection form a Y-shaped support structure.

* * * * *